US006468040B1

(12) United States Patent
Grylls et al.

(10) Patent No.: US 6,468,040 B1
(45) Date of Patent: Oct. 22, 2002

(54) ENVIRONMENTALLY RESISTANT SQUEALER TIPS AND METHOD FOR MAKING

(75) Inventors: Richard J. Grylls, Cincinnati, OH (US); Joseph D. Rigney, Milford, OH (US); Warren D. Grossklaus, Jr., West Chester, OH (US); Melvin R. Jackson, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/624,806

(22) Filed: Jul. 24, 2000

(51) Int. Cl.[7] ..... F01D 5/28

(52) U.S. Cl. ..... 416/224; 416/241 R; 415/173.1; 29/889.2

(58) Field of Search ..... 415/173.1, 173.4, 415/173.6, 174.4; 416/241 R, 224; 29/889.2, 889.72; 228/214, 215, 224.1, 193

(56) References Cited

U.S. PATENT DOCUMENTS

| | | | | | |
|---|---|---|---|---|---|
| 4,214,355 | A | | 7/1980 | Zelahy | 29/156.8 B |
| 4,232,995 | A | | 11/1980 | Stalker et al. | 415/172 A |
| 4,247,254 | A | * | 1/1981 | Zelahy | 416/97 R |
| 4,540,339 | A | * | 9/1985 | Horvath | 416/92 |
| 4,610,698 | A | | 9/1986 | Eaton et al. | 51/295 |
| 4,677,035 | A | | 6/1987 | Fiedler et al. | 428/680 |
| 4,726,104 | A | * | 2/1988 | Foster et al. | 29/156.8 B |
| 4,744,725 | A | | 5/1988 | Matarese et al. | 415/172 A |
| 4,802,828 | A | | 2/1989 | Rutz et al. | 416/241 B |
| 4,808,055 | A | | 2/1989 | Wertz et al. | 416/224 |
| 4,822,248 | A | | 4/1989 | Wertz et al. | 416/192 |
| 5,048,183 | A | | 9/1991 | Cang et al. | 29/889.1 |
| 5,104,293 | A | | 4/1992 | Eaton et al. | 416/241 B |
| 5,160,822 | A | | 11/1992 | Aleshin | 219/121.64 |
| 5,264,011 | A | | 11/1993 | Brown et al. | 51/309 |
| 5,355,637 | A | | 10/1994 | Wiltshire et al. | 51/295 |
| 5,359,770 | A | | 11/1994 | Brown et al. | 29/889.1 |
| 5,448,828 | A | | 9/1995 | Willems et al. | 29/899.1 |
| 5,582,635 | A | | 12/1996 | Czech et al. | 106/14.05 |
| 5,584,663 | A | * | 12/1996 | Schell et al. | 416/241 R |
| 5,622,638 | A | | 4/1997 | Schell et al. | 219/121.64 |
| 5,673,745 | A | | 10/1997 | Jackson et al. | 164/80 |
| 5,743,013 | A | | 4/1998 | Taylor et al. | 239/889.7 |
| 5,778,960 | A | | 7/1998 | Jackson et al. | 164/98 |
| 5,794,338 | A | | 8/1998 | Bowden, Jr. et al. | 29/889.1 |
| 5,813,118 | A | | 9/1998 | Roedl et al. | 29/889.1 |
| 5,817,371 | A | | 10/1998 | Gupta et al. | 427/454 |
| 5,822,852 | A | * | 10/1998 | Bewlay et al. | 29/889.1 |
| 5,879,753 | A | | 3/1999 | Zajchowski et al. | 427/454 |
| 5,890,274 | A | | 4/1999 | Clement et al. | 29/527.2 |
| 5,904,201 | A | | 5/1999 | Jackson et al. | 164/80 |
| 5,935,407 | A | | 8/1999 | Nenov et al. | 205/183 |
| 5,952,110 | A | | 9/1999 | Schell et al. | 428/621 |
| 5,972,424 | A | | 10/1999 | Draghi et al. | 427/142 |
| 6,107,598 | A | * | 8/2000 | Updegrove et al. | 219/121.7 |

* cited by examiner

*Primary Examiner*—Edward K Look
*Assistant Examiner*—Ninh Nguyen
(74) *Attorney, Agent, or Firm*—David L. Narciso; McNees Wallace & Nurick; Carmen Santa Maria

(57) ABSTRACT

A cast turbine airfoil to which a squealer tip is added. The turbine airfoil is cast slightly undersize. The squealer tip is comprised of an alloy that is different from the cast alloy of the airfoil, the oxidation resistance and strength of the squealer tip alloy being greater than the strength of the turbine airfoil alloy. The cast turbine alloy having the added squealer tip can utilize a material in the squealer tip that is more difficult to cast than the cast alloy material, yet is more suited for severe environmental conditions and temperature extremes.

25 Claims, 1 Drawing Sheet

ENVIRONMENTALLY RESISTANT SQUEALER TIPS AND METHOD FOR MAKING

FIELD OF THE INVENTION

The present invention is directed to improvements in the squealer tips of high temperature turbine airfoil components.

BACKGROUND OF THE INVENTION

Components operating in the turbine portion of a gas turbine engine and within the gas flow path of the combustor portion of the engine experience severe a environmental conditions. These parts are subject to significant temperature extremes, approaching the melting temperature of some of the components. In addition, the hot gases of combustion from which energy for operation of the engine is derived are both corrosive and oxidative. Although the alloys that are used in these extreme conditions were especially developed to operate in them, environmental coatings and/or thermal barrier coatings are often applied to the external surfaces of these components to both protect the alloy from the harsh environment and to allow the alloy to withstand higher operating temperatures. Environmental coatings are generally oxidation resistant metallic coatings applied over the structural component; while thermal barrier coating systems are comprised of an underlying bond coat, which can be an environmental coating, and an overlying ceramic thermal barrier layer. Of course, the achievement of higher operating temperatures is an overall objective, as higher operating temperatures generally improve the efficiency of the engine.

The exhaust gases from the combustor are directed through the turbine in such a manner that the hottest gases impinge turbine airfoils, and specifically turbine blades, at or near their tip. In order to extract the maximum amount of energy from the hot stream of exhaust gases, the clearance between the blade tips and the adjacent shrouds is kept at a minimum. However, as a result of dimensional tolerancing stack-up during manufacturing operations and thermal expansion of components during hot operations in the initial cycles of engine operations, as well as certain anticipated events such as occasional hard landings, the tips of the airfoils can severely rub into the shroud. Although the shrouds are designed to be abradable to account for such anticipated rubbing, often the rubbing can adversely affect the blade tip, causing the removal of the outer coating from the tip region. As the outer coating is either a thermal barrier coating or an environmental coating, the exposure of the underlying material produces undesirable results. When a thermal barrier coating is removed by robust contact with the adjacent shroud, the underlying bond coat is exposed to elevated temperatures very early in the life of the engine that it was not designed for. When an environmental coating is removed by robust contact with the adjacent shroud, the underlying superalloy base material is exposed to hot oxidative and corrosive gases very early in the life of the engine from which it was to be protected by the environmental coating.

The consequences of this excess rubbing can be immediate, in that the engine efficiency will be affected by hot gases escaping around the gap between the airfoil and the shroud. As the blade deteriorates more quickly over time as a result of the loss of the overlying protective coating, the engine efficiency will be further reduced. And naturally, the life of the engine will be shortened due to more rapid degradation of the blades.

Various solutions have been attempted to solve the problem of squealer tip wear and deterioration. One illustrative example is set forth in U.S. Pat. No. 5,622,638 to Schell et al. and assigned to the assignee of the present invention. Schell's approach is to apply a special Ni-base alloy as a repair over squealer tips that have been machined in preparation for repair. Many of the solutions deal with repairing cast airfoils removed from service in order to restore their environmentally damaged and worn tips. A similar solution is set forth in U.S. Pat. No. 4,822,248 in which seals are repaired with wear resistant material using plasma arc welding in order to minimize the amount of base metal that is heated to form a metallurgical bond. The patent also discloses adding a wear resistant material to the notch or flat portion adjacent to the cast seal portion of the blade for new blades.

Another approach is set forth in U.S. Pat. No. 5,048,183 to Cang et al. which discloses a method of adding a tip to a turbine blade by weld depositing using weld layered puddling to add a material of predetermined strength less than the blade base metal strength and that is resistant to oxidation and corrosion.

What the prior art lacks is a turbine blade having a squealer tip made of a material that is resistant to oxidation, but has a predetermined strength at least as strong or stronger than the blade base material. While corrosion resistance is not an unimportant property for a squealer tip, it is not as critical as oxidation. Because airfoils are either directionally solidified or single crystal, it is necessary to add the material to the turbine blade in a manner that has a minimal impact on the base material, that is to say, the added material should be added in a manner that minimizes the melting of the underlying base material.

The present invention is directed to overcome the shortcomings of the prior art.

SUMMARY OF THE INVENTION

A squealer tip is added to an otherwise conventionally cast new turbine airfoil. Allowances are made in the casting so that the final airfoil meets product dimensional requirements after the squealer tip is added. The squealer tip is comprised of an alloy that is different from the cast alloy of the airfoil in that it has a predetermined strength that is greater than the cast alloy material and has oxidation resistance that is superior to those of the cast blade, making it more capable of surviving for long periods in the harsh environment of a gas turbine engine. Because the material added to the new airfoil by the squealer tip can be varied, sufficient material can be added by the processes of the present invention to assure that rubbing against the mating turbine shroud occurring during initial engine breaking does not consume all of the added squealer tip. The squealer tip thus can be added so that sufficient environmentally protective material remains after engine break-in to provide environmental protection to the airfoil as the corrosive and oxidative hot gases of combustion flow past the airfoil tip.

In one embodiment, the squealer tip is added to the airfoil casting by a process that minimizes the mixing of the airfoil alloy and the added squealer tip, but which provides a strong mechanical bond and a weak or partial metallurgical bond. To fully develop the metallurgical bond between the airfoil casting and the squealer tip, the airfoil is heat treated for a preselected time at an elevated temperature below the melting point of either alloy but sufficiently high to permit formation of a full metallurgical bond. Excess material may be added to the airfoil casting, which is machined back so that the airfoil with attached blade is within the design tolerances of the drawing.

An advantage of the present invention is that the airfoil can be made of two different alloys, with the alloy exposed to the highest temperatures and the most severe environmental conditions having properties that will extend its life under these conditions. Because alloys capable of withstanding these temperature extremes and severe environmental conditions are more expensive and typically more difficult to cast, the restricted use of the alloy only in the region where these conditions are most severe can reduce the cost of manufacturing the airfoil.

Another advantage of the present invention is that it permits the application of the squealer tip made from a second high temperature, high strength and oxidation resistant alloy to an airfoil casting while minimizing mixing of the two alloys without the concomitant reduction of properties when alloys are joined by processes that involve mixing, such as conventional welding techniques.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Whenever possible, the same reference numbers will be used throughout the figures to refer to the same parts.

DETAILED DESCRIPTION OF THE PRESENT INVENTION

Figure 1:
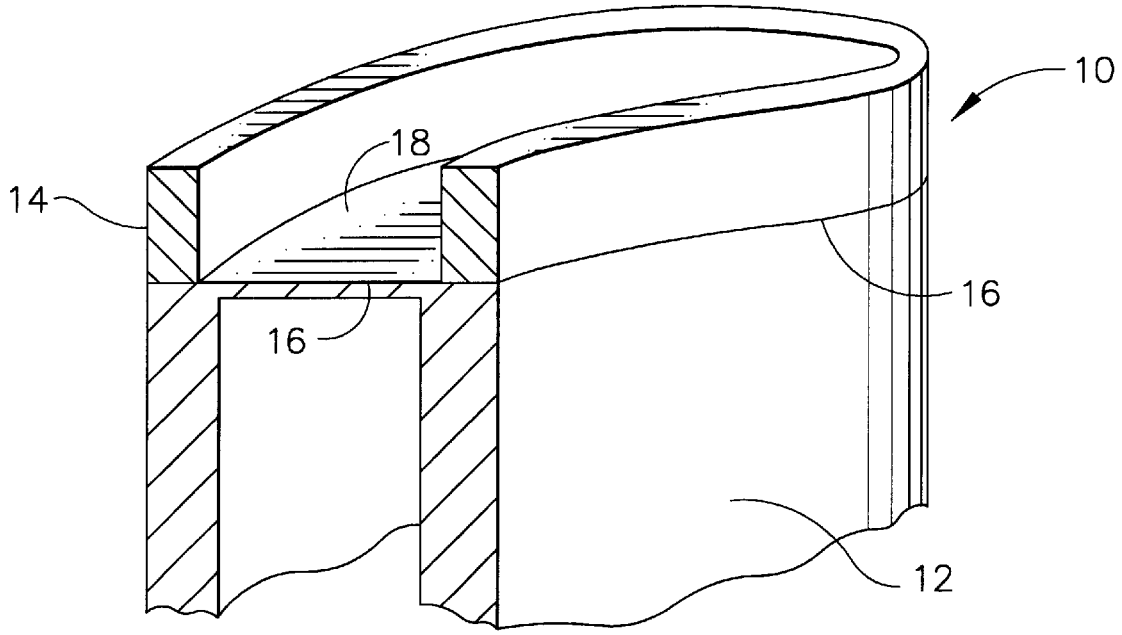
FIG. 1 is a fragmentary, perspective sectional view of an airfoil of the present invention.

Referring to FIG. 1, which is a fragmentary perspective sectional view of a new airfoil 10 of the present invention, that includes the airfoil casting 12 and the attached squealer tip 14. The airfoil casting 12 extends from a dovetail end, not shown, to the tip end 16 so as to have a predetermined length that is less than the overall design length of the airfoil. The airfoil casting typically is manufactured of a first superalloy material having a predetermined high temperature and fatigue strength and good corrosion and oxidation resistance that is cast and solidified using either single crystal techniques or techniques that will provide a directionally solidified casting. Both of these processes for casting turbine airfoils are well known. The directionally solidified castings typically have columnar grain structures that extend in the axial direction, that is, from the dovetail end to the tip end 16.

The present invention provides a squealer tip 14 comprised of a second superalloy material that has a predetermined high temperature strength that is greater than the high temperature strength of the first superalloy material. The second superalloy material also has better oxidation resistance than the first alloy comprising the alloy casting.

The squealer tip may be added using conventional welding practices. This practice will result in an airfoil with superior performance due to the presence of the second superalloy material. Other processing approaches can provide additional performance advantages.

The squealer tip is added to the new casting by a process that minimizes the mixing of the first superalloy material comprising the casting 12 and the second, added superalloy material comprising the squealer tip 14. The mixing invariably involves some melting of the superalloy casting 12. This melting should be kept to a minimum, and if possible, prevented completely. There are two reasons to minimize the melting of the superalloy casting. One reason is that the greater the volume of the superalloy casting that is melted, the greater the mixing between the added second superalloy material and the first superalloy material. This is undesirable as each alloy has a composition that is optimized for a specific purpose, and the region of mixing will produce an alloy that is not optimized. Of specific concern, the superior high temperature strength and environmental resistance of the squealer tip material will be adversely affected by mixing with the first superalloy material of the casting 12. Another reason for minimizing the melting of the first superalloy material of the alloy SONS casting 12, and hence minimizing the mixing effect of the first and second superalloy materials is due to the structure of the casting. The directionally solidified or single crystal nature of a casting used as an airfoil has been developed to provide strength in preselected directions. When remelted and mixed with the second superalloy material, the melted material will resolidify most typically as equiaxed grains. This will undesirably produce a mechanically weakened area in the casting in the region in the vicinity of the tip 16 where stresses will be the highest experienced by the casting. Since the added tip may be equiaxed grain material, the process of the present invention minimally will affect the underlying casting, which maintains its directional grain structure.

While various processes can be used to attach a squealer tip 14 to the casting 12, the present invention contemplates the use of low heat input welding processes that are characterized by minimal amounts of melting of the base material. These processes achieve bonding primarily by mechanically bonding the added metal to the base material and initially do not rely on sound metallurgical bonds between base material and added metal. Typically a high temperature heat treatment is required to fully develop the metallurgical bond. The preferred processes of the present invention include the high velocity oxy-fuel process (HVOF), the detonation gun process (Dgun) and low pressure plasma spray techniques (LPPS). Each of these methods can be tailored in a manner so that there is no significant dilution of the base metal with the added metal. In addition, a large number of parts can be rapidly processed using these processes. These techniques are well known in the art.

Figure 2:
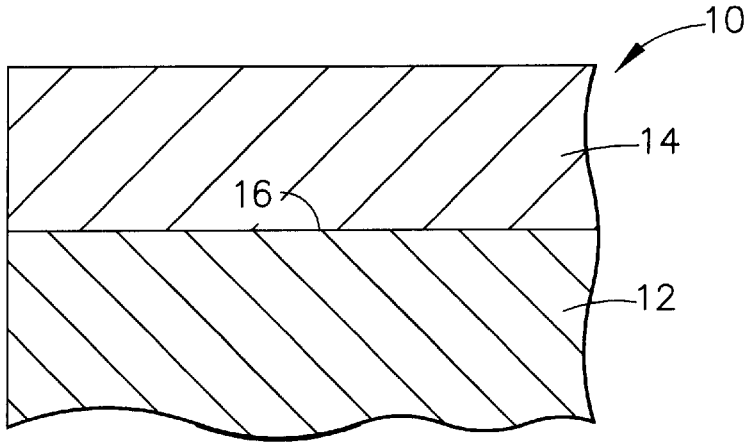
FIG. 2 is an enlarged, sectional, diagrammatic view of the blade tip in FIG. 1.

After an airfoil casting 12 of a first superalloy material, typically a nickel base superalloy material having a predetermined high temperature tensile strength and good fatigue strength, is cast to a predetermined length extending from the dovetail end, not shown in FIGS. 1 and 2, to a tip end 16, a squealer tip of a second superalloy material is applied by one of the preferred methods. Tip end 16 is prepared for the application by masking a central portion 18 of tip end 16. This masking can be done with any common materials used to prevent the deposit of molten droplets of metal on the surface. In the preferred embodiment, the superalloy casting is a typical material used for turbine airfoils such as Rene' 80, Rene' 125, Rene' N5, Rene' 142, Rene' N6 and Rene' 108. These materials have a history of use for airfoil applications and have good environmental resistance and good high temperature strength.

After application of the masking, a second superalloy material is applied around the periphery of the tip end 16 of airfoil casting 12 as a squealer tip 14 to a preselected height extending away from the tip end as illustrated in FIG. 2. The overall length of the airfoil casting 12 and the squealer tip 14 is within or greater than the required design length requirement of the airfoil. The second superalloy material applied as a squealer tip at the end of the airfoil will cut into the mating shroud during the initial operation of the engine. It is desirable for this superalloy material to have good strength. However, because it will be performing a cutting operation, it is also expected that a portion of the material will be sacrificial. The dimensioning of the casting and the squealer tip is such that only a portion of the squealer tip is removed and some of the second superalloy material extends beyond tip end 16 after initial operation. This is an important aspect because the second superalloy material has better oxidation resistance and a greater high temperature tensile strength and fatigue strength than the first superalloy material. These improved properties are desired at the end of an airfoil as the most demanding conditions are at the blade tip. A preferred superalloy for the squealer tip is Rene 142, which typically is used in directionally solidified turbine blades. However, in this application, the Rene 142 is preferably applied to the tip end 16 of the airfoil casting 12 as a powder by the HVOF process.

Because the low heat input method used to apply the squealer tip 14 to casting 12 minimizes melting of the substrate superalloy of the casting, a poor metallurgical bond is formed between the squealer tip 14 and the casting 12. However, at the interface between the squealer tip and casting, there is a minimal amount of dilution of the added second superalloy with the first superalloy of the casting, although the mechanical bond at the interface is strong. However, the airfoil is not operational in this form. To enhance the strength between the squealer tip 14 and casting 12 at interface and form a strong metallurgical bond, the part is heat treated at an elevated temperature above at least 1950° F. and below the melting point of either of the superalloys comprising the blade for a preselected time sufficient to develop the metallurgical bond. Typically this time is about 4 hours or longer, with lower temperatures requiring longer heat treatment times. In a preferred embodiment, the heat treatment is performed in a protective atmosphere at a temperature in the range of 1975–2150° F. for at least about 4 hours. While some elemental diffusion occurs across the interface, the effect of the diffusion is not at all as pronounced as the mixing that occurs when the second material is added to a molten puddle of the first material. In this manner, the beneficial properties of both the underlying first superalloy comprising the casting and the second superalloy comprising the squealer tip can be maintained, with little or no deterioration at their interface.

In another embodiment, the squealer tip is added to the new casting by a process that produces a strong metallurgical bond between the first superalloy material comprising the casting 12 and the second, added superalloy material comprising the squealer tip 14. Any one of a number of processes can be used to add the squealer tip. Commonly used processes include TIG welding, in which a weld rod of the second superalloy material is fed into an advancing puddle of melted substrate, and laser welding, in which a powder is fed into an advancing puddle of molten metal created by the laser. In these processes a portion of the superalloy casting 12 is melted and the second superalloy material is added to the melted material. This process is usually performed on castings that have an equiaxed or non-directional grain structure. Castings made from first superalloy materials which have equiaxed grain structures are usually specified in applications in which strength is not critical. In this situation, there will be a significant mixing of the first and second superalloys, the deposited region will, in virtually all cases, have a higher strength than the underlying casting material. Of course, the melted portion of the first superalloy material as well as the added second superalloy material will solidify with an equiaxed grain structure. While melting of the substrate casting by methods such as laser or TIG may be utilized, it must be recognized that the directionally solidified or single crystal grain structure of the underlying casting will be adversely affected and will resolidify as a weaker, equiaxed grain structure. For those applications in which the casting strength is dependent upon the mechanical properties imparted by the directional grain structure, this structure should only be minimally disturbed, and laser and TIG should not be utilized. In these applications, the previously described alternate embodiment of this invention should be utilized.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A new airfoil for use in a gas turbine engine, comprising:

an airfoil cast of a first superalloy material having a predetermined high temperature strength and oxidation resistance and having a predetermined length extending from a dovetail end to a tip end; and a squealer tip made of a Rene' 142 material having resistance to high temperature oxidation of a preselected height attached to the tip end of the airfoil casting and extending away from the tip end, the Rene' 142 material having a predetermined high temperature strength greater than the high temperature strength of the first superalloy material and oxidation resistance greater than the oxidation resistance of the first superalloy material; and the airfoil and attached squealer tip having an overall length within predetermined design requirements for the airfoil.

2. A method for making a new airfoil for use in a gas turbine engine, comprising the steps of:

casting an airfoil of a first superalloy material extending from a dovetail end to a tip end and with no squealer tip of preselected length shorter than a predetermined design length;

masking a central portion of the tip end of the airfoil;

applying a second superalloy material resistant to high temperature oxidation of a preselected height to the airfoil casting extending away from the tip end and adjacent to the masked central portion of the tip end of the airfoil so that the applied superalloy material forms a seal portion adjacent the masked central portion of the first superalloy material, the masked central portion forming a notch, the second superalloy material having a predetermined high temperature strength greater than the high temperature strength of the first superalloy material, by a using a low heat input welding process to minimize the melting of the first superalloy material;

heat treating the airfoil at an elevated temperature for a preselected time to assure formation of a sound metallurgical bond between the seal portion and the underlying first superalloy material; and machining the seal portion so that an overall length of the machined airfoil is within the design length of the airfoil.

3. The method of claim 2 wherein the step of casting the airfoil includes casting using directional solidified casting techniques.

4. The method of claim 2 wherein the step of casting the airfoil includes casting using single crystal casting techniques.

5. The method of claim 2 wherein the low heat input welding includes a process selected from the group consisting of low pressure plasma spray, detonation gun and HVOF.

6. The method of claim 5 wherein the second superalloy material is applied as a powder.

7. The method of claim 2 wherein the first superalloy airfoil is cast of a nickel base superalloy.

8. The method of claim 7 wherein first superalloy is selected from the group consisting of Rene' 80, Rene' 125, Rene' N5, Rene' 142, Rene' N6 and Rene' 108.

9. The method of claim 8 wherein the second superalloy material applied to the first superalloy material is Rene' 142.

10. The method of claim 2 wherein the second superalloy material applied to the first superalloy material is Rene' 142.

11. The method of claim 2 wherein the step of heat treating the airfoil is performed at a temperature of at least 1950° F. for at least 4 hours to assure formation of a sound metallurgical bond between the seal portion and the underlying first superalloy material.

12. The method of claim 11 wherein the step of heat treating the airfoil is performed at a temperature in the range of 1975–2150° F. for at least 4 hours to assure formation of a sound metallurgical bond between the seal portion and the underlying first superalloy material.

13. A method for making a new airfoil for use in a gas turbine engine, comprising the steps of:

casting an airfoil of a first superalloy material extending from a dovetail end to a tip end of preselected length shorter than a predetermined design length and with no squealer tip;

masking a central portion of the tip end of the airfoil;

applying a second superalloy material resistant to high temperature oxidation of a preselected height to the airfoil casting extending away from the tip end and adjacent to the masked central portion of the tip end of the airfoil so that the applied superalloy material forms a seal portion adjacent the masked central portion of the first superalloy material, the masked central portion forming a notch, the second superalloy material having a predetermined strength greater than the strength of the first superalloy material by a welding process that melts at least a portion of the first superalloy material and adds the second superalloy material to the melted material to produce a sound metallurgical bond between the seal portion and the underlying first superalloy material; and machining the seal portion so that the length of the machined airfoil is within the design length of the airfoil.

14. The method of claim 13 wherein the step of casting an airfoil includes casting a directionally solidified superalloy.

15. The method of claim 14 wherein the step of casting an airfoil includes casting a single crystal superalloy.

16. The method of claim 13 wherein the step of applying the second superalloy material includes applying the second superalloy material by TIG welding.

17. The method of claim 13 wherein the step of applying the second superalloy material includes applying the second superalloy material using laser welding.

18. A new airfoil for use in a gas turbine engine made by the steps of:

casting an airfoil of a first superalloy material extending from a dovetail end to a tip end and with no squealer tip of preselected length shorter than a predetermined design length;

masking a central portion of the tip end of the airfoil;

applying a second superalloy material resistant to high temperature oxidation and of a preselected height to the airfoil casting extending away from the tip end and adjacent to the masked central portion of the tip end of the airfoil so that the applied superalloy material forms a seal portion adjacent the masked central portion of the first superalloy material, the masked central portion forming a notch, the second superalloy material having a predetermined high temperature strength greater than the high temperature strength of the first superalloy material by a using a process that minimizes mixing of the first superalloy material and second superalloy material while forming a strong mechanical and a weak, partial metallurgical bond;

heat treating the airfoil at an elevated temperature below the melting point of both the superalloy and the second superalloy and above about 1975° F. for about 4 hours to form a metallurgical bond between the first superalloy and the applied second superalloy; and machining the seal portion so that an overall length of the machined airfoil is within the design length of the airfoil.

19. The airfoil of claim 18 wherein first superalloy is selected from the group consisting of Rene' 80, Rene' 125, Rene' N5, Rene' 142, Rene' N6 and Rene' 108.

20. The airfoil of claim 18 wherein the second superalloy material applied to the first superalloy material is Rene' 142.

21. The airfoil of claim 18 wherein the step of applying the second superalloy material using a process that minimizes mixing of the first superalloy material and second superalloy material while forming a strong mechanical and a weak, partial metallurgical bond includes a process selected from the group consisting of low pressure plasma spray, detonation gun and HVOF.

22. The airfoil of claim 21 wherein the step of applying the second superalloy further includes applying Rene' 142' powder to the first superalloy.

23. A new airfoil for use in a gas turbine engine made by the steps of:

casting an airfoil of a first superalloy material extending from a dovetail end to a tip end and with no squealer tip of preselected length shorter than a predetermined design length;

masking a central portion of the tip end of the airfoil;

applying a second superalloy material resistant to high temperature oxidation and of a preselected height to the airfoil casting extending away from the tip end and adjacent to the masked central portion of the tip end of the airfoil so that the applied superalloy material forms a seal portion adjacent the masked central portion of the first superalloy material, the masked central portion forming a notch, the second superalloy material having a predetermined strength greater than the strength of the first superalloy material by using a process that forms a strong metallurgical bond by melting at least a portion of the first superalloy material and deposits the second superalloy material into the melted portion of the first superalloy material; and machining the seal portion so that an overall length of the machined airfoil is within the design length of the airfoil.

24. The new airfoil of claim 23 wherein the step of applying the second superalloy material includes applying the second superalloy material using TIG welding.

25. The new airfoil of claim 23 wherein the step of applying the second superalloy material includes depositing the second superalloy material using laser welding.

* * * * *